US006290427B1

(12) United States Patent
Ochoa

(10) Patent No.: US 6,290,427 B1
(45) Date of Patent: Sep. 18, 2001

(54) GUARDRAIL BEAM WITH ENHANCED STABILITY

(76) Inventor: Carlos M. Ochoa, 1301 Barthelow, Suite 4A, College Station, TX (US) 77840-4539

( * ) Notice: Subject to any disclaimer, the term of this patent is extended or adjusted under 35 U.S.C. 154(b) by 0 days.

(21) Appl. No.: 09/405,434

(22) Filed: Sep. 23, 1999

Related U.S. Application Data

(60) Provisional application No. 60/120,171, filed on Feb. 16, 1999.

(51) Int. Cl.[7] ..... E01F 15/00

(52) U.S. Cl. ..... 404/6; 256/13.1

(58) Field of Search ..... 404/6, 9; 256/13.1

(56) References Cited

U.S. PATENT DOCUMENTS

| | | | | |
|---|---|---|---|---|
| 1,847,025 | | 2/1932 | Stockard . | |
| 1,849,167 | | 3/1932 | Bente . | |
| 1,974,232 | | 9/1934 | Brown | 256/13.1 |
| 1,989,763 | | 2/1935 | McFarland | 256/13.1 |
| 2,007,185 | | 7/1935 | Edgecombe | 256/13.1 |
| 2,047,436 | | 7/1936 | Shepherd | 256/13.1 |
| 2,047,990 | | 7/1936 | Carswell et al. | 256/13.1 |
| 2,060,673 | | 11/1936 | Hick | 256/13.1 |
| 2,085,098 | | 6/1937 | Height et al. | 256/13.1 |
| 2,088,001 | | 7/1937 | Schulz | 256/13.1 |
| 2,089,929 | | 8/1937 | Brickman et al. | 256/13.1 |
| 2,091,195 | | 8/1937 | Dennebaum | 267/69 |
| 2,091,925 | | 8/1937 | Heltzel | 256/13.1 |
| 2,135,705 | | 11/1938 | Florance | 256/13.1 |
| 2,168,930 | | 8/1939 | Bradshaw | 256/13.1 |
| 2,204,559 | * | 6/1940 | Ahles | 256/13.1 |
| 2,228,652 | | 1/1941 | Dailey | 256/13.1 |
| 2,536,760 | | 1/1951 | Martin et al. | 256/13.1 |
| 2,776,116 | | 1/1957 | Brickman | 256/13.1 |
| 2,979,307 | | 4/1961 | Crone | 256/13.1 |
| 3,214,142 | | 10/1965 | Brown et al. | 256/13.1 |
| 3,284,054 | | 11/1966 | St. Pierre | 256/13.1 |
| 3,332,666 | | 7/1967 | Gray | 256/13.1 |
| 3,417,965 | | 12/1968 | Gray | 256/13.1 |
| 3,603,562 | | 9/1971 | Glaesener | 256/13.1 |
| 3,776,520 | | 12/1973 | Charles et al. | 256/13.1 |
| 3,845,936 | * | 11/1974 | Boedecker, Jr. et al. | 256/1 |
| 4,063,713 | | 12/1977 | Anolick et al. | 256/13.1 |

(List continued on next page.)

FOREIGN PATENT DOCUMENTS

| | | | |
|---|---|---|---|
| 376 535 | 2/1960 | (CH) . | |
| 378 358 | 6/1961 | (CH) . | |
| 433422 | 8/1966 | (CH) | E01F/15/00 |
| 1 258 539 | 7/1961 | (FR) . | |
| 2 607 841 | 6/1988 | (FR) | E01F/15/00 |

OTHER PUBLICATIONS

Standard Specification for Corrugated Sheet Steel Beams for Highway Guardrail, AASHTO Designation: M 180–89, pp. 309–313.

Standard Specification for Corrugated Sheet Steel Beams for Highway Guardrail, AASHTO Designation: M 180–79, pp. 419–423.

PTC Search Report U.S. 99/29848, May 4, 2000.

Existing Guardrail Shapes.

O–Rail (brochure), Trinity Industries, Inc., 1999.

*Primary Examiner*—H. Shackelford
*Assistant Examiner*—Gary S. Hartmann
(74) *Attorney, Agent, or Firm*—Baker Botts L.L.P.

(57) ABSTRACT

A guardrail beam for installation along a roadway includes a top edge and a bottom edge. A plurality of crowns may be disposed longitudinally along the guardrail beam between the top edge and the bottom edge. A first fold may be disposed upon the top edge and a second fold may be disposed upon the bottom edge. One or more fluted beads are disposed longitudinally along at least one crown. The guardrail beam may also include hemmed portions at the top edge and/or bottom edge at the downstream ends of the guardrail beam.

20 Claims, 8 Drawing Sheets

U.S. PATENT DOCUMENTS

| | | | | |
|---|---|---|---|---|
| 4,222,552 | * | 9/1980 | Matteo, Sr. | 256/13.1 |
| 4,295,637 | | 10/1981 | Hulek | 256/13.1 |
| 4,330,106 | | 5/1982 | Chisholm | 256/13.1 |
| 4,423,854 | * | 1/1984 | Cobb et al. | 256/13.1 |
| 4,460,161 | * | 7/1984 | Grenga | 256/13.1 |
| 4,928,928 | | 5/1990 | Buth et al. | 256/13.1 |
| 5,044,609 | | 9/1991 | Cicinnati et al. | 256/13.1 |
| 5,069,576 | * | 12/1991 | Pomero | 404/6 |
| 5,152,507 | * | 10/1992 | Lee | 256/13.1 |
| 5,407,298 | | 4/1995 | Sicking et al. | 404/6 |
| 5,429,449 | | 7/1995 | Baatz | 404/6 |
| 5,547,309 | | 8/1996 | Mak et al. | 404/6 |
| 5,860,762 | * | 1/1999 | Nelson | 404/6 |
| 5,954,111 | | 9/1999 | Ochoa | 160/201 |
| 5,957,435 | * | 9/1999 | Bronstad | 256/13.1 |
| 5,967,497 | * | 10/1999 | Denman et al. | 256/13.1 |
| 6,059,487 | * | 5/2000 | Haga et al. | 404/6 |
| 6,082,429 | | 7/2000 | Ochoa | 160/201 |
| 6,149,134 | * | 5/2000 | Bank et al. | 256/13.1 |

* cited by examiner

GUARDRAIL BEAM WITH ENHANCED STABILITY

RELATED APPLICATION

This application claims the benefit of U.S. Provisional Application Serial No. 60/120,171 filed Feb. 16, 1999.

TECHNICAL FIELD OF THE INVENTION

The present invention relates generally to roadway safety devices and more particularly, to a guardrail beam with enhanced stability.

BACKGROUND OF THE INVENTION

A goal of roadway safety is to provide a forgiving roadway and adjacent roadside for errant motorists. Guardrails are employed along a roadside to accomplish multiple tasks. Upon vehicle impact, a guardrail must react as a brake and shock absorber to dissipate the kinetic energy of the vehicle. Subsequently, the guardrail acts as a mechanical guide to redirect the vehicle away from hazards during deceleration and to prevent the vehicle from leaving the road, becoming airborne or rebounding into traveled lanes of traffic.

For many years, a standard heavy gauge metal guardrail known as the "W-beam" has been used on the nation's roadways to accomplish these tasks and others. Named after its characteristic shape, the "W-beam" is typically anchored to the ground using posts made of metal, wood or a combination of both.

Recently, there has been a vigorous effort to raise the performance standards which guardrails must satisfy. Increasingly stringent testing criteria have uncovered serious deficiencies in the performance of standard "W-beam" guardrails. Accordingly, recent efforts have focused on development of a new guardrail system that will accomplish safety goals more effectively.

One such design included a deeper and wider "W-beam." However, this change in geometry required a significant increase in hardware to attach adjacent sections of the beam at the splice. Alternative systems have not gained widespread industry acceptance.

SUMMARY OF THE INVENTION

One aspect of the present invention is to provide an improved guardrail system for use in median strips and adjacent to roadways that more evenly spreads the stresses sustained during impact with a vehicle to create a more uniform, stable and predictable response. Another aspect is to provide a cost-effective, retrofitable guardrail which can be employed interchangeably along with, or in lieu of existing guardrail systems. Yet another aspect is to provide a lightweight guardrail with the strength to meet or surpass highway safety standards. Still another aspect is to provide a guardrail capable of dissipating the impact energy of vehicle collision more effectively than existing guardrail systems.

Various technical benefits are attained in accordance with the teachings of the present invention by employing a guardrail beam with a top edge, bottom edge and a plurality of crowns disposed longitudinally between the top edge and the bottom edge. A first fold may be disposed longitudinally along the top edge and a second fold may be disposed longitudinally along the bottom edge. For one embodiment, the first fold and the second fold may have the general configuration of a tubular curl. For some applications, the first and second folds may be hemmed.

In a particular embodiment, one or more fluted beads may be disposed longitudinally along at least one crown.

In another embodiment, a plurality of bolt holes associated with the guardrail beam are configured to allow the guardrail beam to be used interchangeably with existing guardrail systems.

A technical advantage of the present invention includes its ability to effectively withstand and distribute stresses sustained during impact with a vehicle. This enhanced stress distribution minimizes failure of the guardrail beam and provides for a more stable and predictable response during collision. Accordingly, the guardrail beam can withstand significant forces of impact while maintaining adequate safety to vehicles, passengers, and bystanders.

Another technical advantage includes the use of thinner sheets of selected base materials to form sections of the guardrail beam which minimizes costs associated with fabrication, transportation and installation of the guardrail beam.

Still another technical advantage includes a bolt hole configuration which facilitates the retrofit and/or replacement of existing guardrail systems with one or more section of a beam formed in accordance with teachings of the present invention without requiring substantial modifications to existing equipment and other portions of each system.

Other technical advantages are readily apparent to one skilled in the art from the following figures, descriptions, and claims.

BRIEF DESCRIPTION OF THE DRAWINGS

For a more complete understanding of the present invention, and the advantages thereof, reference is now made to the following brief descriptions, taken in conjunction with the accompanying drawings and detailed description, wherein like reference numerals represent like parts, in which.

DETAILED DESCRIPTION OF THE INVENTION

Preferred embodiments of the present invention and its advantages are best understood by referring now in more detail to FIGS. 1–16 of the drawings, in which like numerals refer to like parts.

Figures 1, 1A:
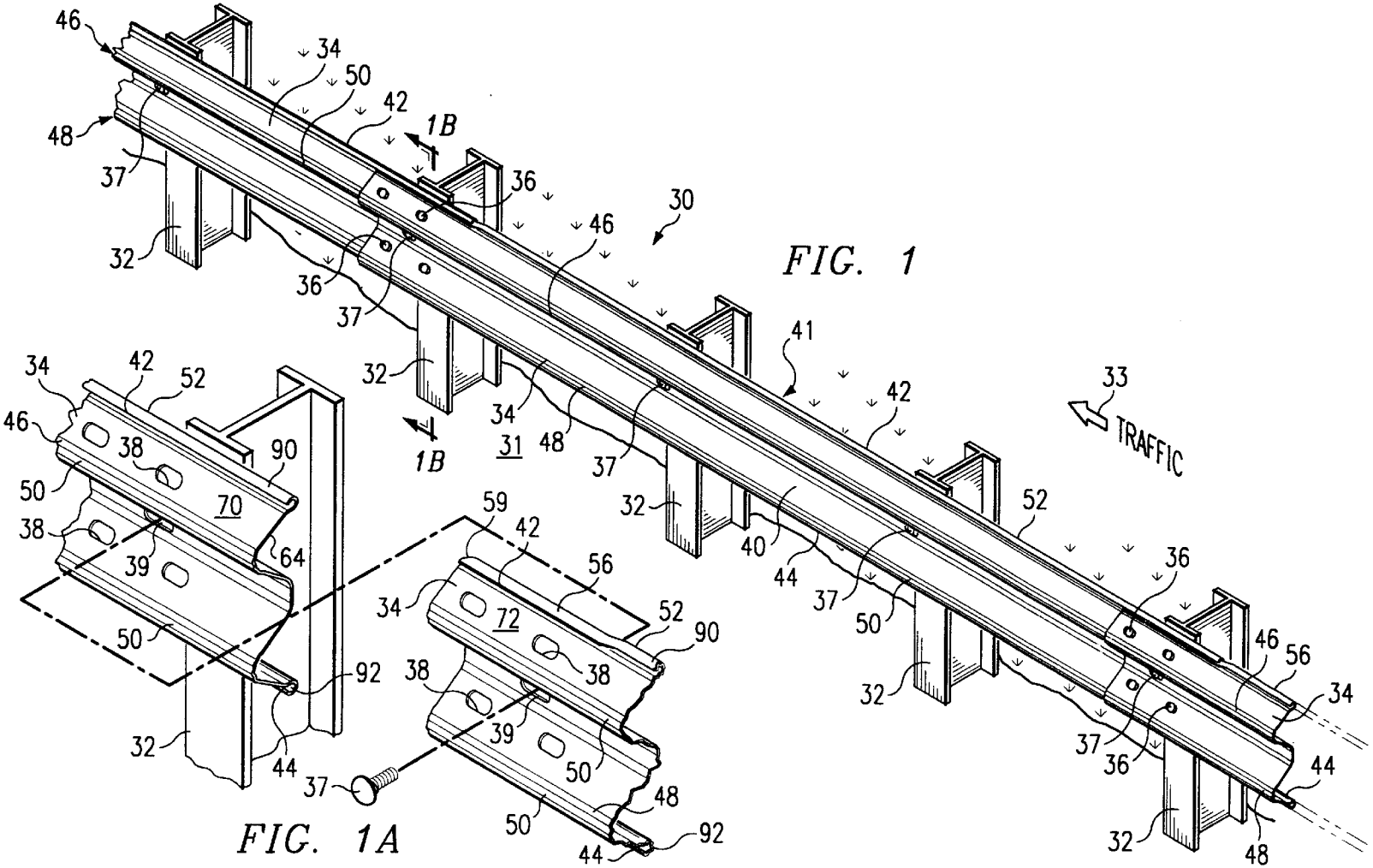
FIG. 1 is an isometric view of a guardrail system installed along a roadway, incorporating aspects of the present invention.
FIG. 1A is an isometric view, with portions broken away, illustrating a splice connection between adjacent sections of guardrail beams, of the guardrail system of FIG. 1.

Referring to FIG. 1, guardrail system 30 is shown installed adjacent to roadway 31. The direction of oncoming traffic along roadway 31 is illustrated by directional arrow 33. Guardrail system 30 includes a plurality of support posts 32 anchored adjacent to roadway 31 with a plurality of guardrail beams 34 attached to support posts 32 and secured by post bolts 37. For illustrative purposes, FIG. 1 includes one complete guardrail beam 34 and two partial sections of adjacent guardrail beams 34 to illustrate the splice connections between adjoining sections.

Guardrail system 30 may be installed along roadway 31 in order to prevent motor vehicles (not expressly shown) from leaving roadway 31 and to redirect vehicles away from hazardous areas without causing serious injuries to the vehicle's occupants or other motorists. Guardrail systems incorporating aspects of the present invention may be used in median strips or shoulders of highways, roadways, or any path which is likely to encounter vehicular traffic.

Support posts 32 are provided to support and maintain guardrail beams 34 in a substantially horizontal position along roadway 31. Posts 32 are typically anchored below or alongside roadway 31. Posts 32 may be fabricated from wood, metal, or a combination of wood and metal. "Break away" support posts may be provided to facilitate a predetermined reaction to a specified crash event.

The number, size, shape and configuration of support posts 32 may be significantly modified within the teachings of the present invention. For instance, support posts may be formed of a material that will break away upon impact, such as wood. In one embodiment, support posts satisfactory for use with the present invention may be formed from two wood sections. The first wood section (not expressly shown) may be disposed underneath roadway 31. The second wood section (not expressly shown) may be disposed above roadway 31 with means for connecting the first wood section with the second wood section. Similarly, support posts 32 may be comprised of two metal sections, the first metal section being an I-beam disposed below roadway 31 and the second metal section being an I-beam disposed above roadway 31, with means for connecting the I-beam sections together. Alternatively, support posts 32 may comprise a combination of metal, wood, or other materials such as composite materials. Various types of support posts will be described later in more detail, in conjunction with the alternative embodiments of FIGS. 13 and 14.

Referring now to FIGS. 1 and 1A, guardrail beams 34 are secured to support posts 32 through a plurality of post bolt slots 39 and corresponding post bolts 37. Similarly, adjacent sections of guardrail beam 34 are coupled with one another by a plurality of splice bolts 36 protruding through splice bolt slots 38. The number, size and configuration of bolts 36 and 37, and slots 38 and 39 may be significantly modified within the teachings of the present invention. In the illustrated embodiment, the configuration of slots 38 and 39 and bolts 36 and 37 comply with American Association of State Highway Transportation Officials (AASHTO) Designation 180-89. Suitable hardware, including nuts and washers may be provided to secure bolts 36 and 37. Various other mechanical fastening techniques and components may be employed within the teachings of the present invention.

Guardrail beams 34 are preferably formed from sheets of a base material such as steel alloys suitable for use as highway guardrail. In one embodiment, guardrail beam 34 may also be designed and fabricated according to AASHTO Designation M180-89. Although the embodiment illustrated in FIG. 1 has a generally "W-Beam" shape, other shapes, including but not limited to a "Thrie-Beam," may be suitable for use within the teachings of the present invention, including the embodiments illustrated in FIGS. 13 and 14.

Guardrail beam 34 is formed in accordance with teachings of the present invention to demonstrate improved safety performance. Recently, increased interest in the need for more stringent safety requirements has culminated in the issuance of the National Cooperative Highway Research Program Report 350 (NCHRP 350). The performance standards of NCHRP 350 require all new safety hardware to be tested with larger vehicles than required by previous standards. NCHRP 350 evaluates all safety hardware within three areas: structural adequacy, occupant risk, and vehicle trajectory. Each area has corresponding evaluation criteria. The Federal Highway Administration (FHWA) officially adopted these new performance standards and has ruled that all safety hardware installed after August of 1998 will be required to meet the new standards.

Figure 2:
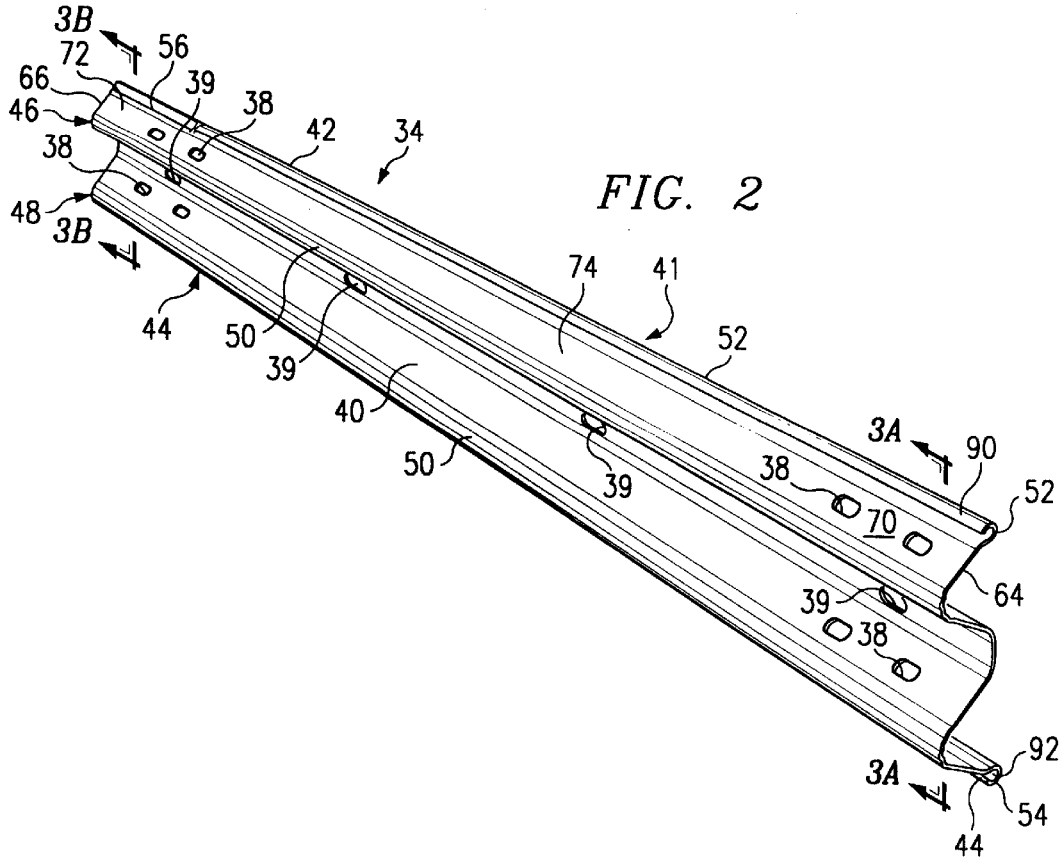
FIG. 2 is an isometric view of a guardrail beam.

The geometric configuration of guardrail beam 34, as illustrated in FIGS. 1 and 2, enhances its ability to respond in a more uniform and predictable manner during crash testing and in-service impacts or collisions.

Guardrail beam 34 comprises front face 40, and a rear face 41, disposed between top edge 42 and bottom edge 44. Front face 40 is preferably disposed adjacent to roadway 31. First crown 46 and second crown 48 are formed between top edge 42 and bottom edge 44. Each crown 46 and 48 may also include a plurality of fluted beads 50, which will be described later in more detail. In a "Thrie-Beam" configuration (see FIGS. 14 and 15), guardrail beam 834 includes a third crown. Top edge 42 and bottom edge 44 terminate at folds 52 and 54, respectively. For the embodiment illustrated in FIG. 2, folds 52 and 54 turn inwardly toward front face 40 of guardrail beam 34, facing one another. The configuration of folds 52 and 54 may vary along the lengths of edges 42 and 44. Various configurations of folds 52 and 54 suitable for use in combination along the top or bottom edge of a particular guardrail beam, or upon alternative embodiments, will be described later in more detail.

Upstream end 70 of each section of guardrail beam 34 is generally defined as the portion beginning at leading edge 64 and extending approximately thirteen (13) inches along guardrail beam 34 toward trailing edge 66. Similarly, downstream end 72 of each section is generally defined as the portion of guardrail beam 34 beginning at trailing edge 66 and extending approximately thirteen (13) inches toward the associated leading edge 64. Intermediate portion 74 of each section of guardrail beam 34 extends between respective upstream end 70 and downstream end 72.

Folds 52 and 54 comprise tubular curls 90 and 92 which preferably extend the entire longitudinal length of top edge 42 and bottom edge 44, respectively, with the exception of downstream end 72. At downstream end 72, top edge 42 and bottom edge 44 terminate at folds 52 and 54 which comprise hemmed portions 56 and 58 (see FIG. 1B), respectively. The respective configurations of folds 90 and 92 and hemmed portions 56 and 58 may vary along the longitudinal length of guardrail beam 34.

Figure 1D:
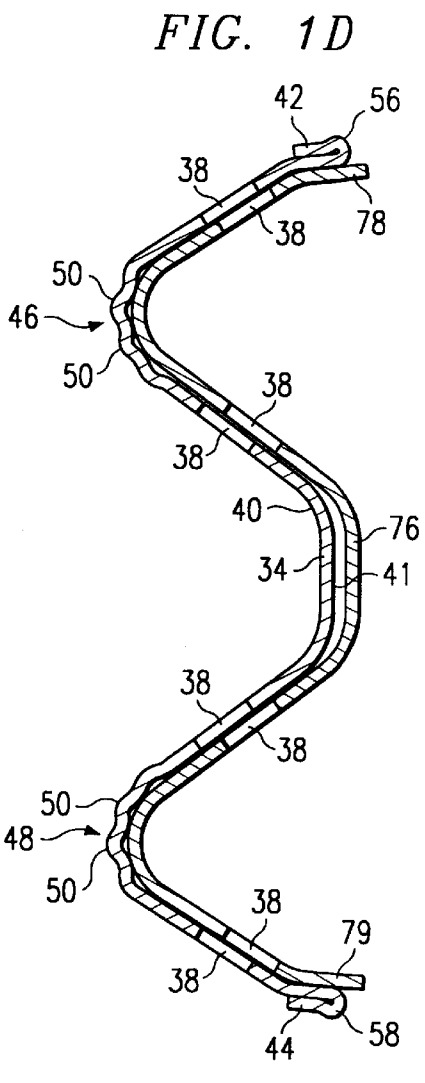
FIG. 1D is a cross section view, illustrating an alternative interconnection between a guardrail beam of the present invention and a conventional guardrail beam.
Figure 1C:
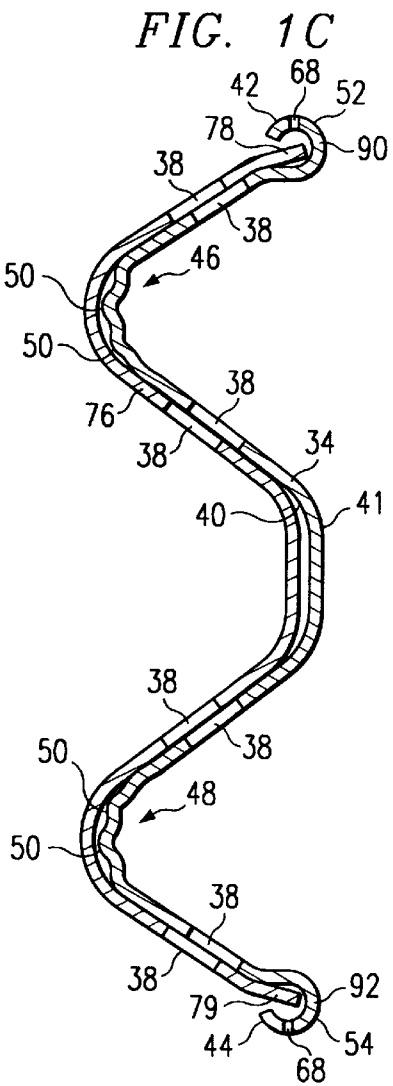
FIG. 1C is a cross section view, illustrating the interconnection between a guardrail beam of the present invention and a conventional guardrail beam.
Figure 1B:
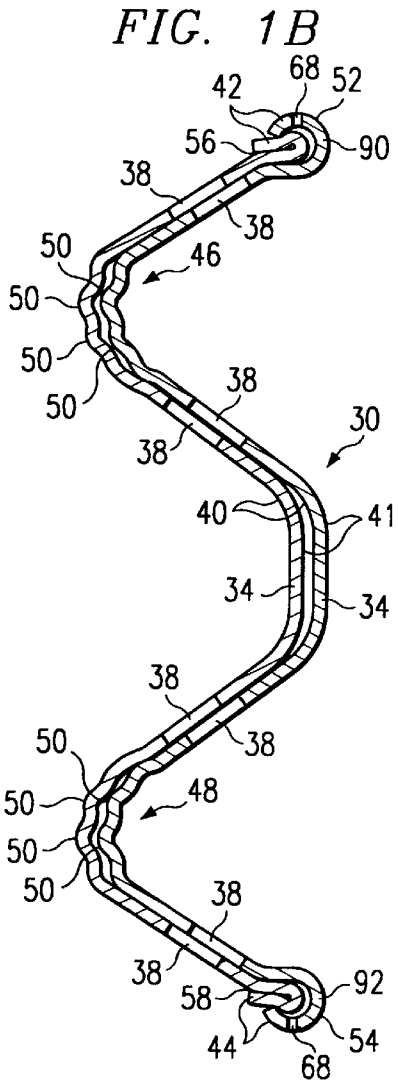
FIG. 1B is a cross section view, taken through the reference line 1B—1B of FIG. 1.

Referring now to FIGS. 1–1B, a splice connection between adjacent guardrail beams 34 is illustrated. Upstream end 70 and downstream end 72 of adjacent guardrail beams 34 are configured to allow tubular curls 90 and 92 to interlock with hemmed portions 56 and 58. Guardrail beams 34 are typically fabricated from a flexible sheetmetal type material which allows adjacent beams to be deformed and "snapped" together to form the interlock at each splice connection. In practice, the interlock between adjacent guardrail beams 34 is formed in a nested fashion, as opposed to adjacent guardrail beams 34 sliding together. The interlock at each splice connection helps keep guardrail beams 34 in alignment, with respect to each other, during a crash event. The interlock also operates to force the loads encountered by guardrail system 30 during a crash event in an axial direction along guardrail beam 34. This load path is optimum for bolted-joint, splice connection performance and for the overall uniform response of guardrail system 30. This results in maximum energy dissipation from a colliding vehicle and thus, the optimum overall performance of guardrail system 30 is achieved.

Figure 16:
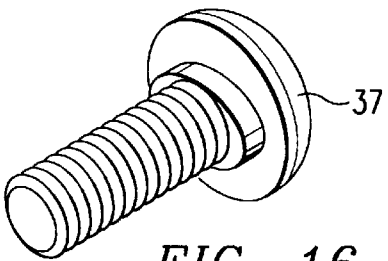
FIG. 16 is an isometric view, illustrating a post bolt suitable for use with the guardrail beam of FIG. 1.

Splice bolt slots 38 and post bolt slots 39 are elongate, and therefore much larger than the diameter of bolts 36 and 37, respectively, which extend therethrough. Slots 38 and 39 allow bolts 36 and 37 additional movement axially and, therefore, absorb a significant fraction of the applied force prior to fracture of bolts 36 and 37. Post bolt slots 39 and post bolts 37 are typically configured similar to, but larger than splice bolt slots 38 and splice bolts 36, respectively. This allows post bolts 37 to absorb additional energy during a crash condition. A post bolt 37, suitable for use within the teachings of the present invention, is illustrated in FIG. 16.

The interlock formed at the splice connection between adjacent guardrail beams 34 provides a predictable response to an externally applied force, for example, a crash event. In many existing guardrails, the guardrail tends to fail first near bolts positioned at the lowermost portion of any particular guardrail beam. Adjacent guardrail beams become dislodged from their respective support posts in the following manner. A bending force applied through the guardrail beam or directly at a support post causes separation of the guardrail beams from the post. The interlock between adjacent guardrail beams 34 of the present invention minimizes nonuniform bending at the splice and allows adjacent sections of guardrail beam 34 to slide axially relative to one another while minimizing local bending in the vertical plane or separation of the splice connection. When the splice is impacted directly by an external force, nonuniform deformation and thus local concentration of stresses that may cause failure of the splice joint is minimized. Also, forces from applied loads are distributed more uniformly between adjacent sections of guardrail beam 34, splice bolts 36 and post bolts 37.

The extreme edges of hemmed portions 56 and 58, at their termination adjacent trailing edge 66, may be chamfered as generally designated in FIG. 1A with the reference numeral 59, at approximately a forty-five-degree angle. Also, the fold may be trimmed and rough edges may be mitered in order to avoid any rough edges. In this manner, the extreme corners and edges of hemmed portions 56 and 58 are less likely to tear adjacent guardrail beams 34 at tubular curls 90 and 92 of adjacent guardrail beam 34. This accommodates axial sliding of one guardrail beam 34 with respect to an adjacent guardrail beam 34 without forming a snag, or a tear. The chamfered edges 59 are particularly useful where hemmed portions 56 and 58 are coupled with folds 52 and 54 of adjacent guardrail beam 34, but also provide similar advantages where guardrail beam 34 is coupled with conventional guardrail beams 76 (see FIG. 1D). In some instances the fold may be partially removed or trimmed in order to accommodate various manufacturing operations, or to facilitate guardrail installation.

As illustrated in FIG. 1B, a plurality of weep holes 68 may be incorporated into tubular curls 90 and 92. Weep holes 68 prevent the buildup of water within the lowermost tubular curl 92. This operates to drain any water which collects in tubular curl 92 and prevent a buildup which may lead to corrosion. Areas of local corrosion could potentially create weak points and contribute to the failure of guardrail beam 34. In the illustrated embodiment, weep holes 68 are provided in the lowermost tubular curl 92 as well as the uppermost tubular curl 90 in order to provide a reversible application such that either tubular curl 90 or 92 may be located at the lowermost position of guardrail beam 34.

In one embodiment, weep holes 68 may be provided every two to three longitudinal feet along guardrail beam 34. In the same embodiment, the diameter of weep holes may be approximately equal to or less than one quarter of the diameter of tubular curl 92. The size, number and configuration of weep holes may be significantly varied within the teachings of the present invention, as required by given ambient conditions.

The configurations of FIGS. 1A and 1B illustrate the interconnection between adjacent sections of guardrail beam 34 of the present invention. Guardrail beam 34 may also be used in conjunction with, and alongside conventional guardrail beams 76, as illustrated in FIG. 1C. Folds 52 and 54 and the overall geometry of guardrail beam 34 allow a combination between guardrail beam 34 and conventional guardrail beam 76 within a single guardrail system, to maintain the benefits described herein. Accordingly, guardrail beams 34 may be incorporated into existing guardrail systems as needed, and an entire retrofit of any particular guardrail system is not required in order to recognize the benefits of the present invention. In a manner similar to that described with respect to FIGS. 1A and 1B, edges 78 and 79 of conventional guardrail beam 76 cooperate with folds 52 and 54, to distribute loads during a crash event. In fact, the overall geometry of guardrail beam 34 is configured to accommodate a close fit between conventional guardrail beams 76 and guardrail beams 34, respectively.

FIG. 1D illustrates a cross section view of guardrail beam 34 coupled with conventional guardrail beam 76. This configuration is available where upstream end 70 of guardrail beam 34 is coupled with conventional guardrail beam 76. Hemmed portions 56 and 58 cooperate with edges 78 and 79 to allow guardrail beams 34 and 76 to slide relative to one another during a crash event as described previously.

Figure 3A:
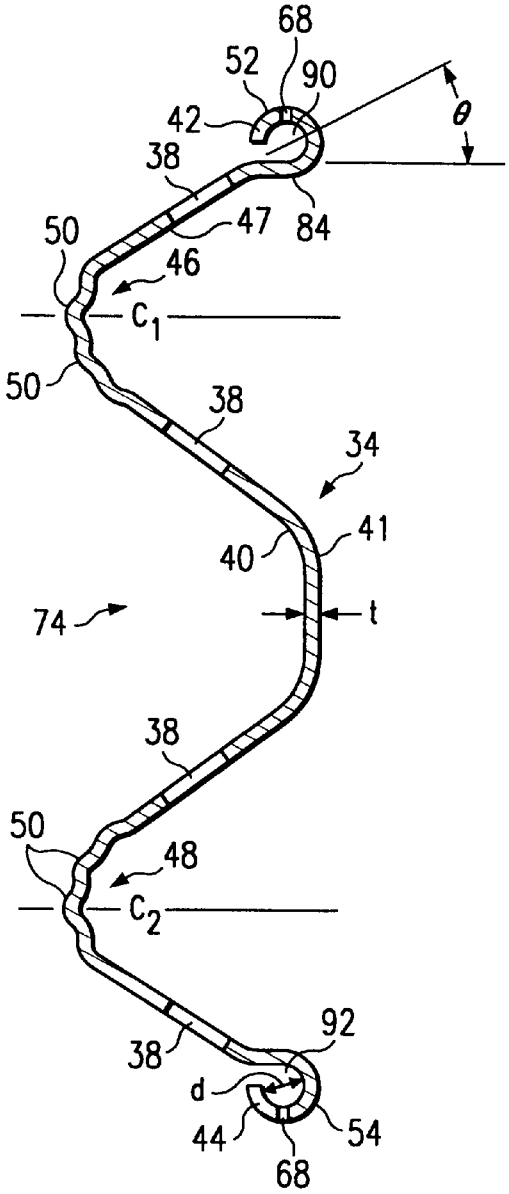
FIG. 3A is a cross section view, taken along line 3A—3A of the guardrail beam of FIG. 2.

The cross sectional configuration of folds 52 and 54, taken through intermediate portion 74, is illustrated in FIG. 3A. At this location, folds 52 and 54 have the general configuration of tubular curls 90 and 92. Tubular curls 90 and 92 have a generally circular cross section with a circumference which extends approximately two hundred and seventy degrees of a unit circle centered within tubular curls 90 and 92. In another embodiment to be discussed later in more detail, tubular curls 90 and 92 may extend approximately three hundred and sixty degrees along a unit circle. In the same embodiment, tubular curls 90 and 92 may have an outer diameter d of approximately three-fourths of an inch (¾" ).

The cross section of FIG. 3A illustrates a plurality of fluted beads 50 associated with each of first crown 46 and second crown 48. Fluted beads 50 effectively redistribute material from areas of less significance to areas of critical importance during a crash event. Fluted beads 50 direct deformation of guardrail beam 34 in a direction parallel to guardrail beam 34, thus absorbing more energy by strengthening guardrail beam 34 in the longitudinal direction. Although three fluted beads 50 are illustrated upon each crown 46 and 48 in the embodiment of FIG. 1B, the total number of fluted beads 50 may be increased or decreased according to various design considerations within the teachings of the present invention. In one particular embodiment, five fluted beads may extend longitudinally along the tip of each crown 46 and 48. In the same embodiment, all of the fluted beads 50 occurring upon first crown 46 are within one and one-half inches of center line C1. Similarly, all of the fluted beads associated with second crown 48 may be within one and one-half inches of centerline C2. In the illustrated embodiment, fluted beads 50 are generally rounded and a smooth transition is provided between adjacent fluted beads 50. This minimizes stress concentration points typically associated with sharp transitions or bends. These shapes are also easier to manufacture and provide reduced wear and tear on tools of manufacture.

In another embodiment, guardrail beam 34 may be bent around a corner, or an obstacle. This bending of guardrail beam 34 will deform fold 52 into an elliptical configuration, rather than a generally circular cross section. The elliptical configuration maintains many of the benefits described herein.

Splice bolt hole 38 is formed within an upper face 47 of guardrail beam 34. Upper face 47 terminates at a curl flange 84. Curl flange 84 forms the transition between upper face 47 and tubular curl 90. Curl flange 84 and tubular curl 90 cooperate to form an edge stiffener for everything below edge 42. This minimizes possible buckling of the entire guardrail beam 34 during a crash event. By maximizing the length of curl flange 84, the total area of the region between curl 90 and curl flange 84 is maximized.

As illustrated in FIG. 3A, an angle θ is formed at the transition between upper face 47 and curl flange 84. In the illustrated embodiment, θ is approximately equal to thirty degrees. This enables the edge stiffener behavior and also facilitates the incorporation of guardrail beams 34 into existing guardrail systems. Angle θ may be significantly modified within the teachings of the present invention.

Figure 3B:
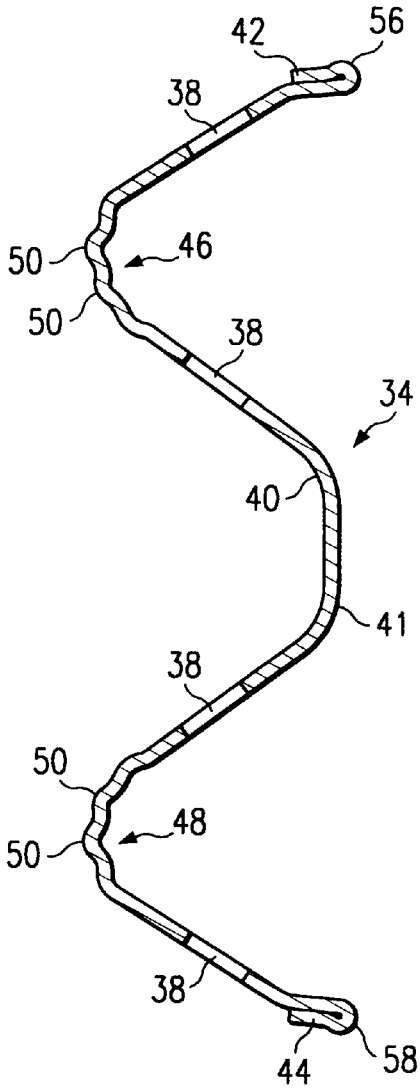
FIG. 3B is a cross section view, taken along line 3B—3B of the guardrail beam of FIG. 2.

FIG. 3B illustrates the cross sectional configuration of folds 52 and 54, taken through downstream end 72. As shown, folds 52 and 54 at downstream end 72 comprise hemmed portions 56 and 58. Hemmed portions 56 and 58 allow additional lengths or sections of guardrail beam 34 to be installed on existing sections of guardrail beam 34 or on conventional guardrail beams 76, with an overlap of approximately thirteen inches. Various design considerations and configurations of folds 52 and 54, including hemmed portions 56 and 58, and tubular curls 90 and 92, are illustrated in FIGS. 5 through 12 and will be discussed later, in more detail.

A vehicle traveling along the right side of roadway 31 will approach from upstream end 70 or leading edge 64 and subsequently depart from downstream end 72 or trailing edge 66 of guardrail beam 34. Each section of guardrail beam 34 is preferably joined with additional sections of guardrail beam 34 such that they are lapped in the direction of oncoming traffic to prevent edges which may "snag" a vehicle or object as it travels along front face 40 of guardrail beam 34. Accordingly, a section of guardrail beam installed at leading edge 64 would be installed upon front face 40 of guardrail beam 34, typically forming an overlap of approximately thirteen inches. An additional guardrail beam installed at trailing edge 66 may be installed upon the rear face 41 of guardrail beam 34, forming an overlap of approximately thirteen inches.

Folds 52 and 54 provide for more uniform stress distribution across the associated guardrail section during vehicle impact. This allows more material to deform during a crash event thereby absorbing additional energy. Guardrail beams 34 are subject to a tremendous amount of twisting during a crash event which results in a significant amount of stress concentrating on top edge 42 and bottom edge 44. Conventional guardrail beams do not contain folds 52 and 54 and typically terminate with "blade edges" at the top and bottom of the cross section (see FIG. 1C). These edges are susceptible to imperfections in the sheet of base material as well as damage during manufacture, shipping, handling, and installation. Imperfections along the edges of conventional guardrail beams may become stress concentration points or focal points at which failure of the guardrail can initiate during impact, and frequently results in tearing of the guardrail.

Even a perfect, smooth "blade edge" of a conventional "W-beam" will experience a very localized point of high stress gradient due to the characteristic edge stress concentration associated with open sections of guardrail under bending loads. Thus, initiation of an edge "bulge" or "crimp" on a perfect, smooth blade edge is an imperfection that will grow or propagate easily and rapidly. This stress concentration may be made worse by the presence of any relatively small edge imperfections, even those on the order of size of the thickness of the sheet of base material used to fabricate conventional guardrail beams.

Folds 52 and 54 stabilize guardrail beam 34 and make it more resistant to twisting while also spreading stresses at top edge 42 and bottom edge 44 thereby substantially decreasing the tendency of guardrail beam 34 to tear upon impact. This allows more uniform deformation of guardrail beam 34 between edges 42 and 44, for example, deformation of first and second crowns 46 and 48, while edges 42 and 44 remain relatively aligned with one another and maintain their strength. Accordingly, forces or loads may travel uniformly upstream to downstream through guardrail beam 34 axially. Forces will not tend to deviate from a lateral axis running parallel with edges 42 and 44.

Folds 52 and 54 maximize the residual strength of guardrail beam 34, which makes guardrail beam 34 resistant to tear at its midsection, and prevents cracks from forming. In one embodiment, the optimum range of tubular curl 90 of FIG. 3A is approximately 230–270 degrees. The size of tubular curls 90 and 92 may be significantly modified within the teachings of the present invention.

The largest rigidity of guardrail beam 34 will be achieved when tubular curls 90 and 92 have the greatest diameter. Assuming d equals the diameter of tubular curl 90, t equals the thickness of the sheetmetal, optimum performance may be achieved when d\t is less than or equal to 10. This provides maximum rupture strength. Also, for ultimate stackability during transportation and handling, large diameter curls 90 and 92 are preferred. The lower limit of the diameter of tubular curl 90 is related to the size required in order to splice into conventional guardrail systems. Tubular curl 90, for example, should be large enough to accept a blade edge 78 therein, in order to combine conventional guardrail beams 76 with guardrail beams 34 of the present invention.

The diameter of tubular curls 90 and 92 are constant throughout edges 42 and 44, except at downstream and 72, where hemmed portions 56 and 58 occur. This simplifies fabrication. In another embodiment, tubular curls 90 and 92 may have larger diameters at upstream ends 70 in order to provide a simplified connection with hemmed portion 56 and 58 of an adjacent guardrail beam 34, or blade edges 78 and 79 associated with a conventional guardrail beam 76.

In order to substantially impair the performance of guardrail beam 34, any edge imperfections must be approximately equal to the diameter d of folds 52 and 54, which is significantly larger than the thickness of the associated sheet of base material used to fabricate conventional guardrail beams. Folds 52 and 54 provide a more stabilized edge feature which more effectively dissipates the impact energy of a vehicle colliding with the guardrail. Hemmed portions 56 and 58 of FIG. 3B also provide for simplified installation of guardrail beam 34 within any given guardrail system having multiple guardrail beams or sections. It will be recognized by those skilled in the art that hemmed portions 56 and 58 provide similar benefits associated with tubular curls 90 and 92, discussed and illustrated throughout this application by increasing the thickness of the edge condition.

Upon a vehicle's impact with a guardrail, a dynamic response is obtained from the guardrail. The response may include vibration of the guardrail in a direction parallel to the ground and perpendicular to the direction of the vehicle. Conventional guardrail beam sections may respond somewhat effectively when the waves are in a direction away from the vehicle. However, as the guardrail returns in a direction toward the vehicle, conventional guardrail beams tend to buckle or crimp at the top and bottom edges. At this point, the guardrail beam's ability to absorb energy by plastic moment is significantly deteriorated. Furthermore, as the vehicle continues its path along the guardrail, it interacts with the edge of the buckled section. This may result in tearing of the sheet of base material initiating at the top edge or bottom edge and may occur in the region where two guardrail beams are overlapped.

The synergistic effect of the geometric configuration of guardrail beam 34, including folds 52 and 54, first crown 46, second crown 48 and their associated fluted beads 50 includes retarding buckling by the appropriate redistribution of material about the cross section to increase the section properties of guardrail beam 34, thereby increasing the failure resistance or buckling load capacity. This effectively optimizes the distribution of mass within the guardrail beam similar to an I-beam's mass redistribution as compared to a solid rectangular section. Therefore, guardrail beam 34 exhibits significantly improved strength and resistance to bending and deflection, as compared to conventional guardrail beams. Folds 52 and 54 stabilize the guardrail and make it more resistant to twisting, while also distributing the stresses at top edge 42 and bottom edge 44, thereby decreasing peak stresses and thus the risk of a tear in the sheet of base material. Fluted beads 50 redistribute the mass of guardrail beam 34 to provide more material at the point of impact during a collision.

Guardrail beam 34 of FIG. 2 may retain some of the standard dimensions associated with conventional "W-Beam" guardrails. Furthermore, bolt holes 38 may be configured to allow guardrail beam 34 to be installed along side of, and to be retrofitable with conventional "W-Beam" guardrail, when desirable. Guardrail beam 34 may also be used in conjunction with a variety of guardrail end treatments including those currently available and in widespread use.

Guardrail beam 34 of the present invention may be manufactured employing conventional "roll form" methods utilizing 0.068 inch thick steel alloy material. This is a substantially lighter gauge material than conventional guardrail beams and allows a total weight savings of approximately twenty-five percent (25%). Accordingly, guardrail system 30 of the present invention is stronger, allowing the component sheetmetal material to be lighter and thinner than in conventional applications. This simplifies installation, by allowing hemmed portion 56 and 58 to be deformed and interlocked with folds 52 and 54. Also, individual sections of guardrail beam 34 are lighter and easier to handle which simplifies maneuverability, for instance in lining up bolt holes during installation. Another advantage of thinner sheetmetal is provided in that the lighter guardrail beam 34 may deform locally more readily during a crash event, as opposed to propagating waves through the rest of guardrail beam 34.

The total length of a typical section of guardrail beam 34 measured from leading edge 64 to trailing edge 66 as illustrated in FIG. 1, is approximately twenty-five (25) feet. Other lengths of guardrail section including, but not limited to one-half lengths, or twelve and one-half foot members, may also be provided within the teachings of the present invention.

Figure 4:
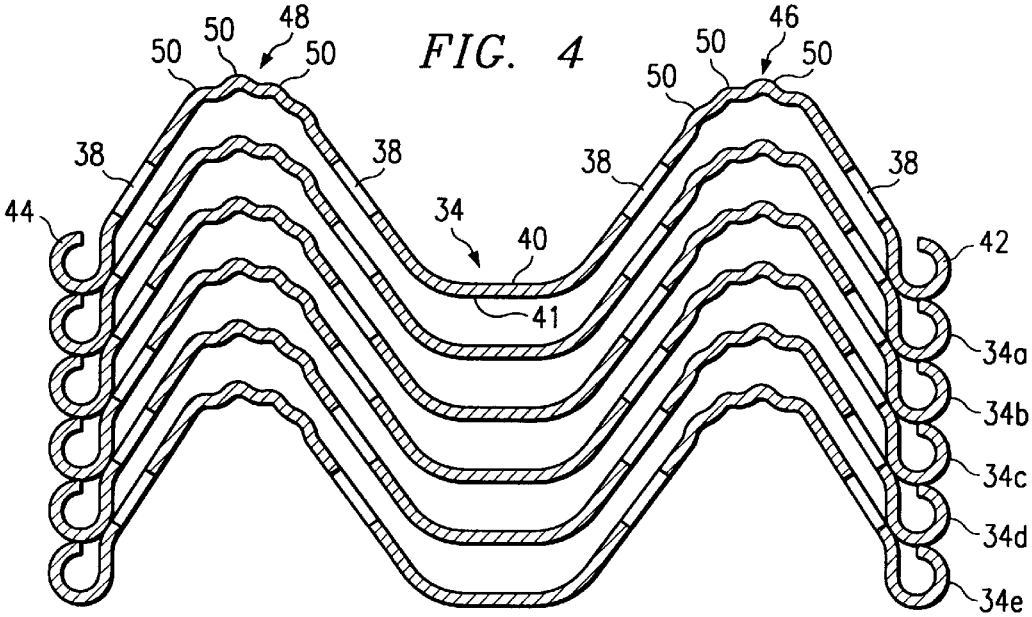
FIG. 4 is a cross section of a number of guardrail beams stacked upon one another, illustrating aspects of the present invention.

Referring to FIG. 4, guardrail beam 34 may be stacked upon additional guardrail beams 34*a*, 34*b*, 34*c*, 34*d*, and 34*e*. This feature facilitates simplified manufacture, storage, delivery and handling of multiple guardrail beams. Accordingly, substantial savings in material, labor and transportation of guardrail beams incorporating aspects of the present invention, will be recognized.

Figure 5:
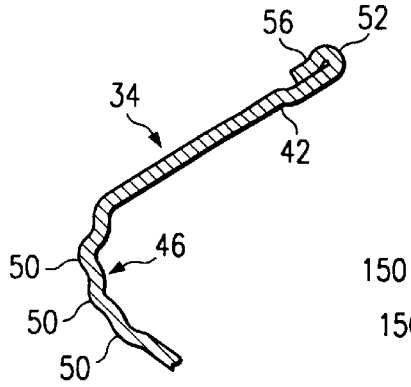
FIG. 5 is a partial cross section, with portions broken away, illustrating an edge configuration available for use with the guardrail system of FIG. 1.

FIGS. 5–12 illustrate various guardrail beam design configurations suitable for use within the teachings of the present invention. FIG. 5 illustrates a cross section taken through a portion of guardrail beam 34 at downstream end 72 (see FIG. 2). Fluted beads 50 are located upon first crown 46. Top edge 42 terminates at fold 52 configured as hemmed portion 56, to allow for another guardrail beam to be installed upon guardrail beam 34. Fold 52 provides additional material and additional strength to top edge 42 to withstand greater stresses, including twisting, without tearing.

Figure 6:
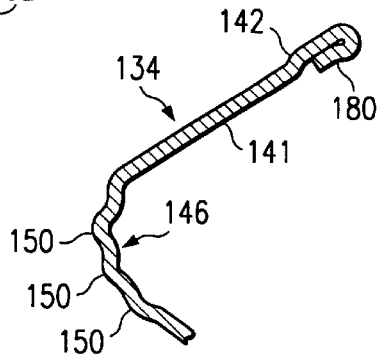
FIG. 6 is a partial cross section, with portions broken away, illustrating an alternative edge configuration.

FIG. 6 illustrates an alternative configuration for the top edge 142 of a guardrail beam 134. Guardrail beam 134 comprises fluted beads 150 disposed upon first crown 146 similar to guardrail beam 34 of FIGS. 1 through 4. In contrast to guardrail beam 34, hemmed portion 180 of top edge 142 is lapped inward, toward rear face 141. Hemmed portion 180 provides benefits to guardrail beam 134 similar to those which hemmed portion 56 provides to guardrail beam 34.

Figure 7:
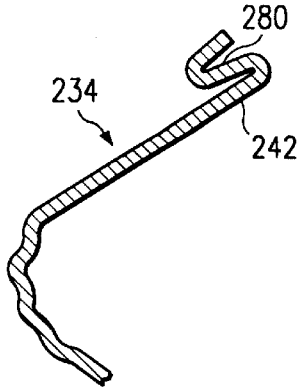
FIG. 7 is a partial cross section, with portions broken away, illustrating another alternative edge configuration.

FIG. 7 illustrates yet another alternative available for the top edge of a guardrail beam. As shown, hemmed portion 280 associated with guardrail beam 234 is lapped over twice, to provide additional material at top edge 242.

Figure 8:
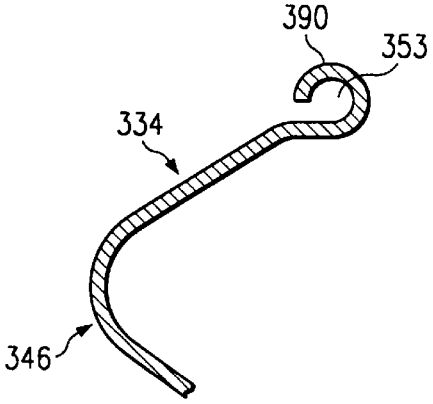
FIG. 8 is a partial cross section, with portions broken away, illustrating another alternative edge configuration.

A cross section through a portion of guardrail beam 334 is illustrated in FIG. 8. Notably, there are no fluted beads present on crown 346 of guardrail beam 334. It will be recognized by those skilled in the art that the presence or absence of fluted beads from a given guardrail beam does not determine the type of edge condition necessary for the guardrail beam. Fluted beads may, or may not be utilized interchangeably with each edge condition described and illustrated within this application.

Furthermore, many of the edge conditions discussed and illustrated throughout this application as occurring at the top edge or bottom edge of a guardrail beam, may be utilized interchangeably on the top edge, bottom edge or both. Furthermore, the edge conditions prevalent at the downstream ends, upstream ends, and/or intermediate portion of a given guardrail beam may also be utilized interchangeably. It will be recognized by those skilled in the art, that a single guardrail beam may employ one particular edge condition at the top edge, and the same or a different edge condition at the bottom edge, and that these edge conditions may occur at either of the ends, the intermediate portion, or both. As utilized throughout this application, the term "edge condition" refers to the configuration of the termination of the guardrail beam at either the top edge or the bottom edge of the guardrail beam.

Accordingly, tubular curl 390, associated with guardrail beam 334 is configured similar to tubular curl 90, associated with guardrail beam 34. Therefore, tubular curl 390 will function similarly to tubular curl 90 as described above.

Figure 9:
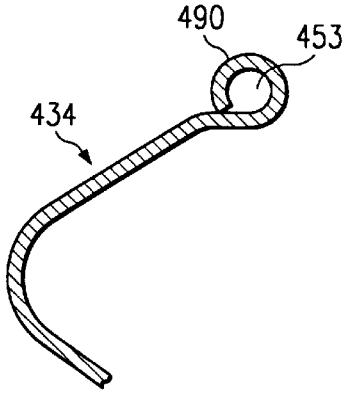
FIG. 9 is a partial cross section, with portions broken away, illustrating another alternative edge configuration.

As illustrated in FIG. 9, tubular curl 490, associated with guardrail beam 434, has a circular cross section which completely encloses a round opening 453. To this extent, the circumference of tubular curl 490 travels approximately three hundred and sixty degrees of a unit circle centered at the midpoint of round opening 453. In contrast, the circumference of tubular curl 390 (see FIG. 8) travels approximately two hundred and seventy degrees along a similar unit circle centered within enclosed portion 353 associated with tubular curl 390. As discussed previously, conventional guardrail beams 76 (see FIG. 1C) have free edges, or blade edges 78 and 79 at their associated edge condition. This may be described as a zero degree circumference associated with the edge condition.

It will be recognized by those skilled in the art that guardrail beams 34 with edge conditions, or tubular curls 90 and 92 circumferences ranging from approximately zero degrees to a full three hundred and sixty degrees may be utilized within the teachings of the present invention. Furthermore, the circumference of a given tubular curl may travel further than 360 degrees and begin or continue along an imaginary unit circle, lapping over any number of times.

Figure 10:
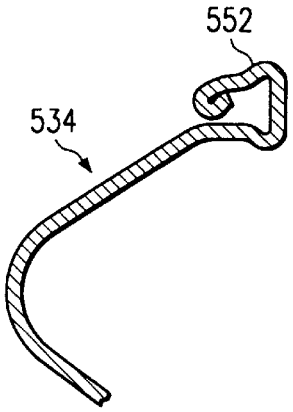
FIG. 10 is a partial cross section, with portions broken away, illustrating another alternative edge configuration.
Figure 11:
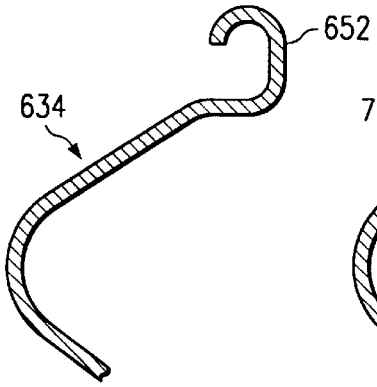
FIG. 11 is a partial cross section, with portions broken away, illustrating another alternative edge configuration.

FIGS. 10 and 11 illustrate additional edge condition configurations suitable for use within the teachings of the present invention. As illustrated, folds 552 and 652 associated with guardrail beams 534 and 634 respectively, need not form a semicircular or circular configuration. Many geometric configurations are available to obtain the benefits associated with the edge conditions discussed and illustrated throughout this application.

Figure 12:
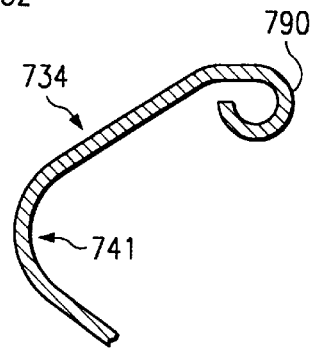
FIG. 12 is a partial cross section, with portions broken away, illustrating another alternative edge configuration.

As illustrated in FIG. 12, and in contrast to tubular curl 90 of guardrail beam 34 (see FIGS. 1–2), tubular curls 790 curls inward toward rear face 741 of guardrail beam 734. This configuration retains the benefits associated with tubular curl 90 by removing the blade edge associated with conventional guardrail beams and strengthening the edge condition. Each edge condition discussed and illustrated within this application may be reversed to face outward, or toward the rear face of a given guardrail beam, or inward, toward the front face of the guardrail beam, within the teachings of the present invention.

Figure 13:
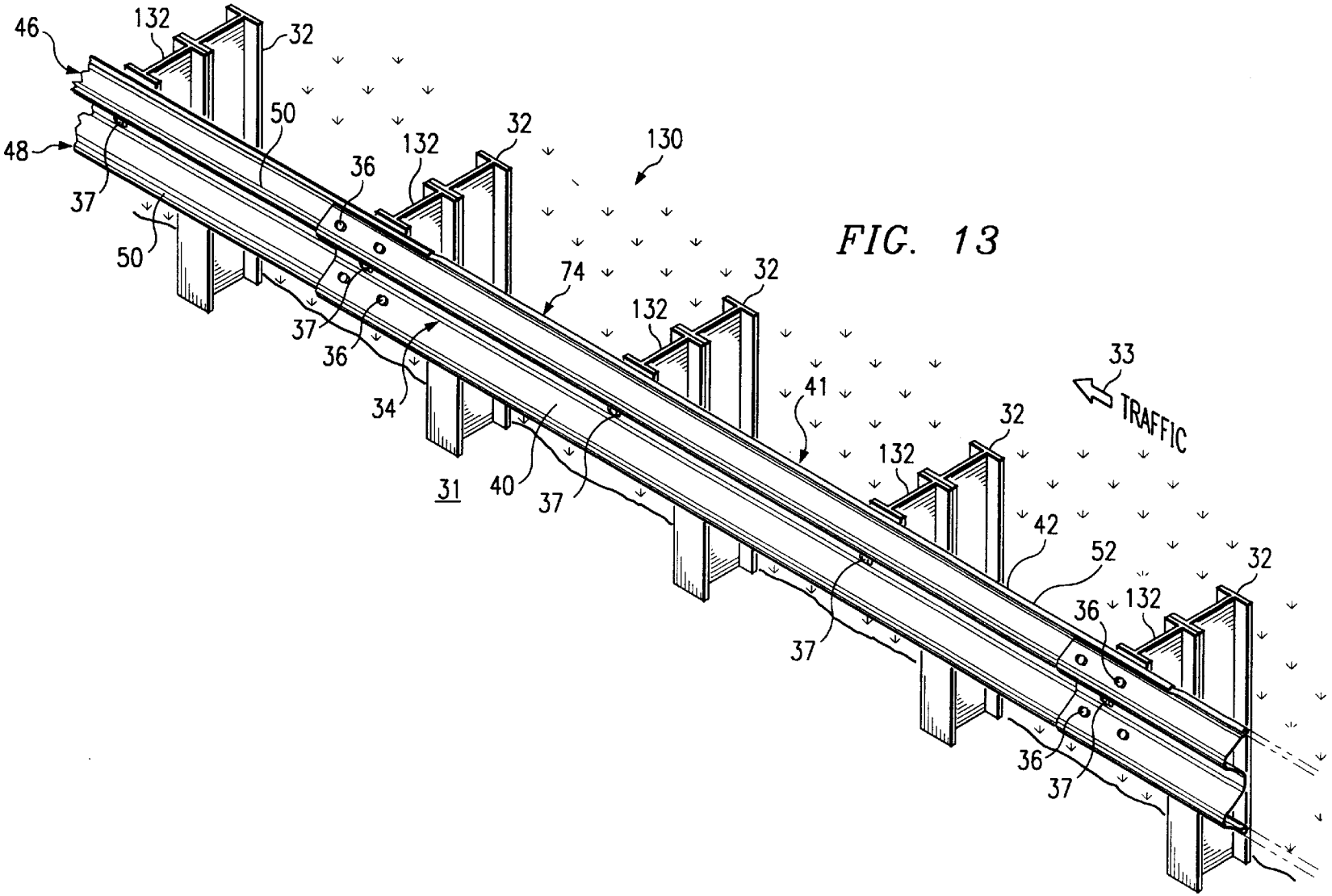
FIG. 13 is an isometric view, with portions broken away, illustrating a guardrail beam, incorporating teachings of the present invention, installed along a roadway using blockouts and support posts.

Referring to FIG. 13, guardrail system 130 is shown installed adjacent to roadway 31. Guardrail system 130 includes many of the same features and components as previously described guardrail system 30. For the embodiment of the present invention as shown in FIG. 13, guardrail system 130 includes a plurality of blackouts 132 which are disposed between respective support posts 32 and backface 41 of guardrail beam 34.

Figure 14:
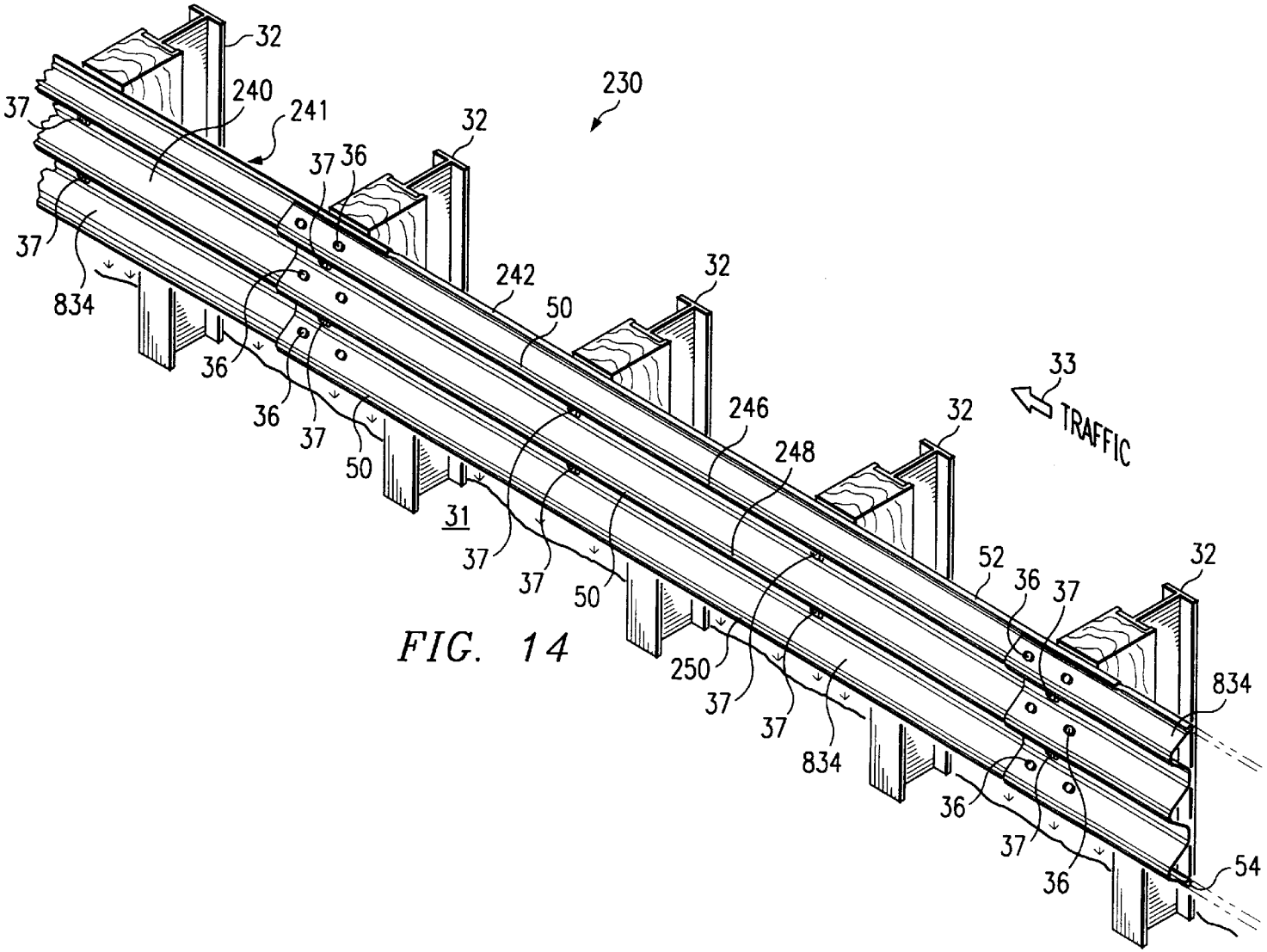
FIG. 14 is an isometric view, with portions broken away, illustrating a guardrail system incorporating still further aspects of the present invention installed along a roadway.

Guardrail system 230 incorporating a further embodiment of the present invention is shown in FIG. 14 installed adjacent to roadway 31. Guardrail system 230 includes a plurality of support posts 32 anchored adjacent to roadway 31 with guardrail beam 834 attached to posts 32 by a plurality of post bolts 37. Guardrail system 230 includes many of the components and features of previously described guardrail system 30. For the embodiment of the present invention as shown in FIG. 14, guardrail beam 34 has been replaced by guardrail beam 834. Guardrail beam 834 as shown in FIGS. 14 and 15 may sometimes be referred to as a thrie-beam.

Figure 15:
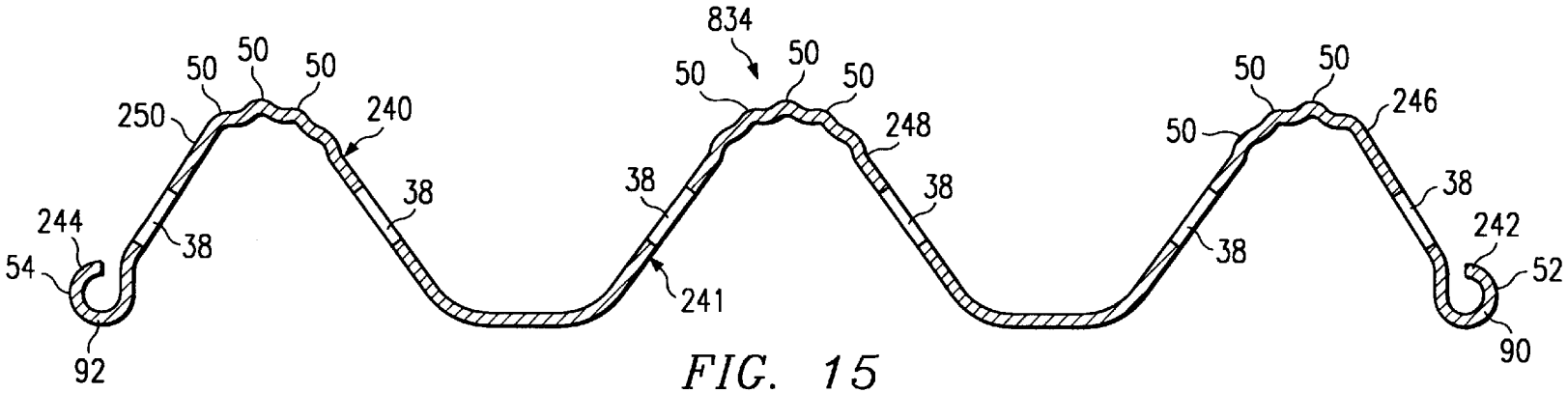
FIG. 15 is a cross section view, illustrating a guardrail beam associated with the guardrail system shown in FIG. 14.

As best shown in FIGS. 14 and 15, guardrail beam 834 includes front face 240 and a rear face 241. Guardrail beam 230 is preferably mounted on support post 32 with front face 240 disposed adjacent to roadway 31.

Guardrail beam 834 also includes first edge 242 and second edge 244. For the embodiment of the present invention as shown in FIG. 15, the configuration of first edge 242 corresponds generally with previously described top edge 42 and second edge 244 corresponds generally with previously described bottom edge 44. Guardrail beam 834 also includes first crown 246, second crown 248 and third crown 250 disposed between first edge 242 and second edge 244. First edge 242, first crown 246, second crown 248, third crown 250 and second edge 244 extend generally parallel with each other along the length of guardrail beam 834. First edge 242 and second edge 244 may include respective folds 52 and 54 which were described in detail with respect to guardrail beam 34.

For the embodiment of the present invention as shown in FIGS. 14 and 15, folds 52 and 54 have the general configuration of previously described tubular curls 90 and 92. However, folds 52 and 54 may have various configurations such as shown in FIGS. 5–12. First crown 246, second crown 248 and third crown 250 may also include a plurality of fluted beads 50 such as previously described with respect to guardrail beam 34.

For some applications, a guardrail beam may be provided with a fold formed in accordance with teachings of the present invention extending along only one longitudinal edge. Also, a guardrail beam may be provided with only one crown having fluted beads formed in accordance with teachings of the present invention.

Although the present invention has been described by several embodiments, various changes and modifications may be suggested to one skilled in the art. It is intended that the present invention encompasses such changes and modifications as fall within the scope of the present appended claims.

What is claimed is:

1. A guardrail beam for installation along a roadway, comprising:

a top edge;

a bottom edge;

a plurality of crowns disposed longitudinally along the guardrail beam between the top edge and the bottom edge;

the crowns corresponding with the configuration of a conventional W-beam guardrail;

a plurality of fluted beads disposed longitudinally along at least one crown;

a plurality of splice bolt slots formed in the guardrail beam;

a plurality of post bolt slots formed in the guardrail beam for attaching the guardrail beam to a plurality of support posts;

a first fold disposed longitudinally along the top edge;

a second fold disposed longitudinally along the bottom edge; and the first fold and the second fold cooperating with each other to more uniformly distribute loads applied to the guardrail at the splice bolt slots and the post bolt slots and to minimize buckling during a crash event.

2. The guardrail beam of claim 1, further comprising a plurality of weep holes disposed within the second fold.

3. The guardrail beam of claim 1, further comprising:

an upstream end;

a downstream end spaced longitudinally from the upstream end;

an intermediate portion disposed between the upstream end and the downstream end, wherein the first and second folds form generally tubular first and second curls within the upstream and intermediate portion; and the first and second folds form first and second hemmed portions at the downstream end.

4. The guardrail beam of claim 3, further comprising:

an interior diameter associated with each of the first and second curls; the guardrail beam comprising sheet metal having a generally uniform thickness; and the ratio of the interior diameter to the thickness approximately equal to or less than ten.

5. The guardrail beam of claim 4, wherein the interior diameter is approximately within the range of 0.5 to 0.75 inches.

6. The guardrail beam of claim 3, wherein a circumference associated with each of the first and second curls is approximately within the range of 200 to 270 degrees.

7. The guardrail beam of claim 3, further comprising a curl flange forming a transition between an upper face of the guardrail beam and the first curl and an angle formed between the curl flange and the upper face approximately equal to or greater than twenty five degrees.

8. The guardrail beam of claim 3, wherein the first and second hemmed portions extend approximately thirteen inches longitudinally along the downstream end of the guardrail beam.

9. The guardrail beam of claim 8, wherein edges associated with the first and second hemmed portions are chamfered.

10. The guardrail beam of claim 1, further comprising the splice bolt slots configured to allow the guardrail beam to be installed as part of a conventional W-beam guardrail system.

11. The guardrail beam of claim 1, further comprising:

a rear face; and the first and second folds turn toward the rear face.

12. The guardrail beam of claim 1, further comprising:

a front face; and the first and second folds turn toward the front face.

13. A guardrail beam for installation along a roadway, comprising:

a top edge;

a bottom edge;

at least one crown disposed longitudinally along the guardrail beam between the top edge and the bottom edge;

at least three fluted beads disposed longitudinally along the at least one crown; and a first fold disposed longitudinally along the top edge.

14. A guardrail beam for installation along a roadway, comprising:

a top edge and a bottom edge;

an upstream end and a downstream end spaced longitudinally from the upstream end;

at least two crowns disposed longitudinally along the guardrail beam between the top edge and the bottom edge;

at least three fluted beads disposed longitudinally along each crown;

a first tubular curl disposed on the top edge at the upstream end and second tubular curl disposed on the bottom edge at the upstream end;

a first hem portion disposed on the top edge at the downstream end and a second hemmed portion disposed on the bottom edge at the downstream end;

a curl flange forming a transition between an upper face of the guardrail beam and the first tubular curl; and an angle formed between the curl flange and the upper face approximately equal to or greater than twenty-five degrees.

15. A guardrail beam for installation along a roadway, comprising:

a top edge;

a bottom edge;

at least one crown disposed longitudinally along the guardrail beam between the top edge and the bottom edge; and at least one fluted bead formed in and disposed longitudinally along the at least one crown.

16. The guardrail beam of claim 15, further comprising a first fold disposed along the top edge, and a second fold disposed along the bottom edge which cooperate with the at least one fluted bead to minimize buckling of the guardrail beam.

17. The guardrail beam of claim 16 wherein at least a portion of the first and second folds form first and second hemmed portions.

18. The guardrail beam of claim 16 wherein at least a portion of the first and second folds form first and second tubular curls.

19. The guardrail beam of claim 15 further comprising:

an upstream end;

a downstream end spaced longitudinally from the upstream end;

an intermediate portion disposed between the upstream end and the downstream end;

a first tubular curl disposed along the top edge at the upstream end and the intermediate portion;

a second tubular curl disposed along the bottom edge at the upstream end and the intermediate portion;

a first hemmed portion disposed on the top edge at the downstream end; and a second hemmed portion disposed on the bottom edge at the downstream end.

20. A guardrail beam for installation along a roadway, comprising:

a top edge;

a bottom edge;

at least one crown disposed longitudinally along the guardrail beam between the top edge and the bottom edge;

at least three fluted beads disposed longitudinally along the at least one crown; and a first fold disposed longitudinally along the bottom edge.

* * * * *